US011398343B2

(12) United States Patent
Yang et al.

(10) Patent No.: US 11,398,343 B2
(45) Date of Patent: Jul. 26, 2022

(54) COIL COMPONENT

(71) Applicant: SAMSUNG ELECTRO-MECHANICS CO., LTD., Suwon-si (KR)

(72) Inventors: Ju Hwan Yang, Suwon-si (KR); Byeong Cheol Moon, Suwon-si (KR); Joung Gul Ryu, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 934 days.

(21) Appl. No.: 16/161,869

(22) Filed: Oct. 16, 2018

(65) Prior Publication Data

US 2019/0333687 A1 Oct. 31, 2019

(30) Foreign Application Priority Data

Apr. 25, 2018 (KR) ..... 10-2018-0047922

(51) Int. Cl.
*H01F 27/29* (2006.01)
*H01F 17/00* (2006.01)
(Continued)

(52) U.S. Cl.
CPC ..... *H01F 27/292* (2013.01); *H01F 17/0013* (2013.01); *H01F 41/042* (2013.01);
(Continued)

(58) Field of Classification Search
CPC ..... H01F 27/292; H01F 17/0013
See application file for complete search history.

(56) References Cited

U.S. PATENT DOCUMENTS

2015/0287516 A1* 10/2015 Park ..... H01F 27/292 29/602.1
2016/0086714 A1* 3/2016 Moon ..... H01F 17/0013 336/192
(Continued)

FOREIGN PATENT DOCUMENTS

CN 105428001 A 3/2016
CN 105957692 A 9/2016
(Continued)

OTHER PUBLICATIONS

Chinese Office Action dated Oct. 23, 2020 issued in Chinese Patent Application No. 201811502324.x (with English translation).
(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil component is disclosed. The coil component includes a body having one surface and the other surface opposing each other, and a plurality of wall surfaces connecting one surface and the other surface to each other; a coil part embedded in the body and having both ends exposed to both end surfaces of the plurality of wall surfaces of the body, opposing each other; an insulating layer covering one surface of the body; and first and second external electrodes disposed on both end surfaces of the body, respectively, to extend onto the insulating layer, and including a bonded conductive layer disposed on the insulating layer, and an external conductive layer disposed on the bonded conductive layer, respectively.

16 Claims, 4 Drawing Sheets

(51) Int. Cl.
*H01F 41/04* (2006.01)
*H01F 17/04* (2006.01)

(52) U.S. Cl.
CPC ... *H01F 41/046* (2013.01); *H01F 2017/0073* (2013.01); *H01F 2017/048* (2013.01)

(56) References Cited

U.S. PATENT DOCUMENTS

| | | | | |
|---|---|---|---|---|
| 2016/0086716 | A1* | 3/2016 | Choi | H01F 27/292 336/221 |
| 2016/0225517 | A1* | 8/2016 | Choi | H01F 27/292 |
| 2016/0240296 | A1 | 8/2016 | Kim et al. | |
| 2016/0268038 | A1* | 9/2016 | Choi | H01F 27/255 |
| 2017/0323725 | A1* | 11/2017 | Iso | H01F 41/046 |
| 2017/0330673 | A1* | 11/2017 | Sato | H01F 27/022 |
| 2018/0337001 | A1* | 11/2018 | Tozawa | H01B 1/22 |
| 2020/0365315 | A1* | 11/2020 | Kim | H01F 17/04 |

FOREIGN PATENT DOCUMENTS

| | | | |
|---|---|---|---|
| CN | 111448628 | A | 7/2020 |
| JP | 2007-305830 | A | 11/2007 |
| JP | 2011-040612 | A | 2/2011 |
| JP | 2017-204565 | A | 11/2017 |
| KR | 10-1548862 | B1 | 8/2015 |
| KR | 10-1580411 | B1 | 12/2015 |
| KR | 10-2016-0099882 | A | 8/2016 |
| KR | 10-2016-0108935 | A | 9/2016 |

OTHER PUBLICATIONS

Office Action issued in corresponding Korean Application No. 10-2018-0047922, dated May 15, 2019.

* cited by examiner

COIL COMPONENT

CROSS-REFERENCE TO RELATED APPLICATION(S)

This application claims the benefit of priority to Korean Patent Application No. 10-2018-0047922 filed on Apr. 25, 2018 in the Korean Intellectual Property Office, the disclosure of which is incorporated herein by reference in its entirety.

BACKGROUND

1. Field

The present disclosure relates to a coil component.

2. Description of Related Art

An inductor, which is a type of coil component, is a representative passive electronic component used in an electronic device, together with a resistor and a capacitor.

As electronic devices gradually improve in performance and become smaller in size, the number of electronic components used in such electronic devices has increased while being miniaturized.

External electrodes of the coil component are typically formed by applying a conductive paste, or by a plating process. In the former case, thicknesses of the external electrodes are increased and a thickness of the coil component may thus be increased, and in the latter case, since a plating resist, necessary for plating, is formed, the number of processes may be increased.

SUMMARY

An aspect of the present disclosure may provide a coil component which is advantageous for thinning.

An aspect of the present disclosure may also provide a coil component having an improved breakdown voltage (BDV).

An aspect of the present disclosure may also provide a coil component having improved flatness of amounting surface.

According to an aspect of the present disclosure, a coil component may include an insulating layer covering one surface of a body, and external electrodes including a bonded conductive layer disposed on the insulating layer and an external conductive layer disposed on the bonded conductive layer.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
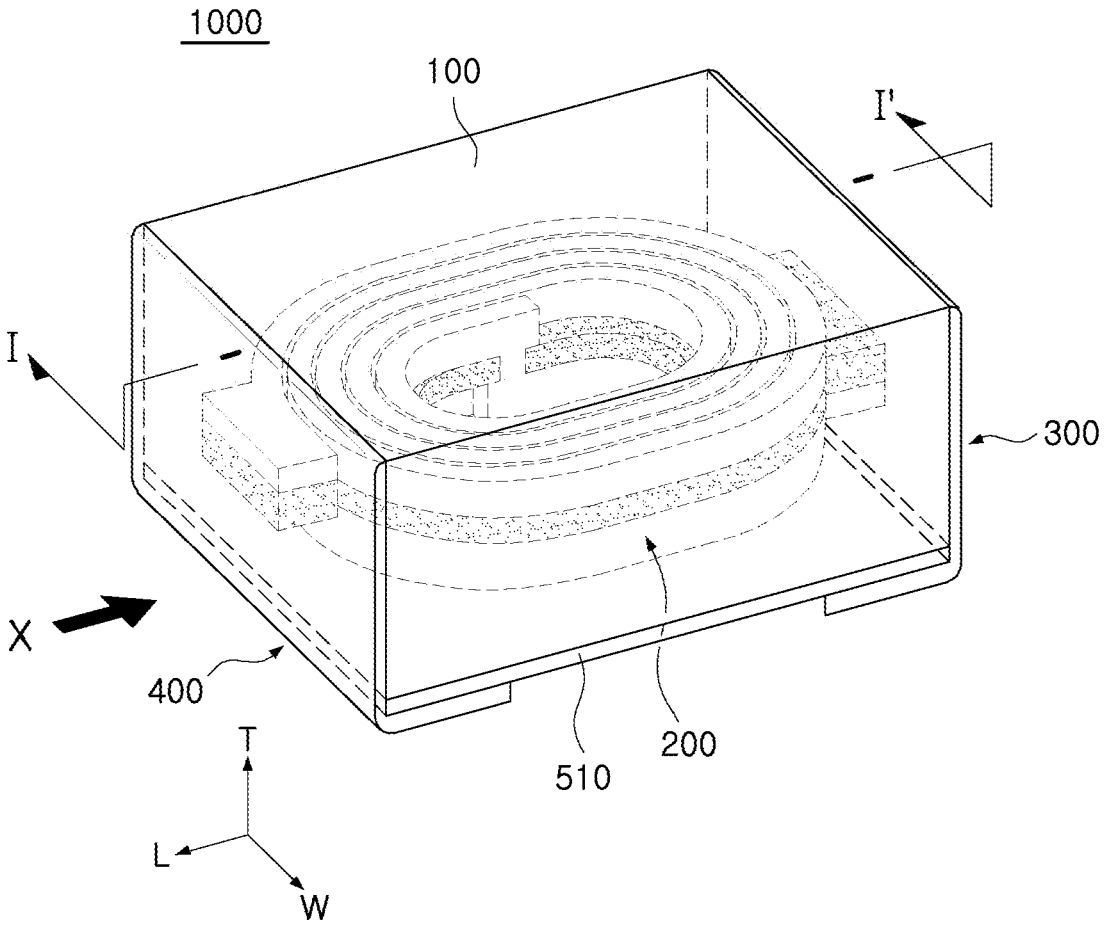
FIG. 1 is a perspective view schematically illustrating a coil component according to a first exemplary embodiment in the present disclosure.

Hereinafter, exemplary embodiments of the present disclosure will now be described in detail with reference to the accompanying drawings.

In the drawings, an L direction refers to a first direction or a length direction, a W direction refers to a second direction or a width direction, and a T direction refers to a third direction or a thickness direction.

Hereinafter, a coil component according to an exemplary embodiment in the present disclosure will be described in detail with reference to the accompanying drawings. In describing an exemplary embodiment in the present disclosure with reference to the accompanying drawings, components that are the same as or correspond to each other will be denoted by the same reference numerals, and an overlapped description thereof will be omitted.

Various types of electronic components may be used in electronic devices. Various types of coil components may be appropriately used for the purpose of noise removal or the like between such electronic components.

That is, a coil component in the electronic device may be used as a power inductor, a high frequency (HF) inductor, a general bead, a high frequency (GHz) bead, a common mode filter, or the like.

First Exemplary Embodiment

Figure 2:
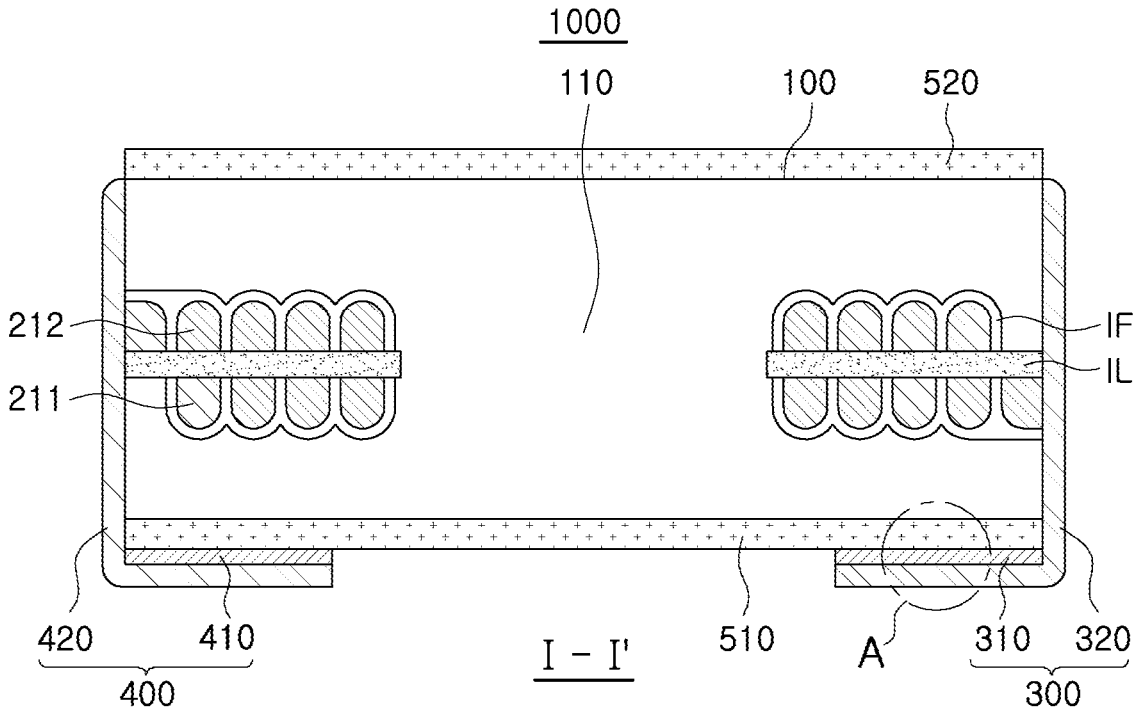
FIG. 2 is a view illustrating a cross section taken along a line I-I' of FIG. 1.
Figure 3:
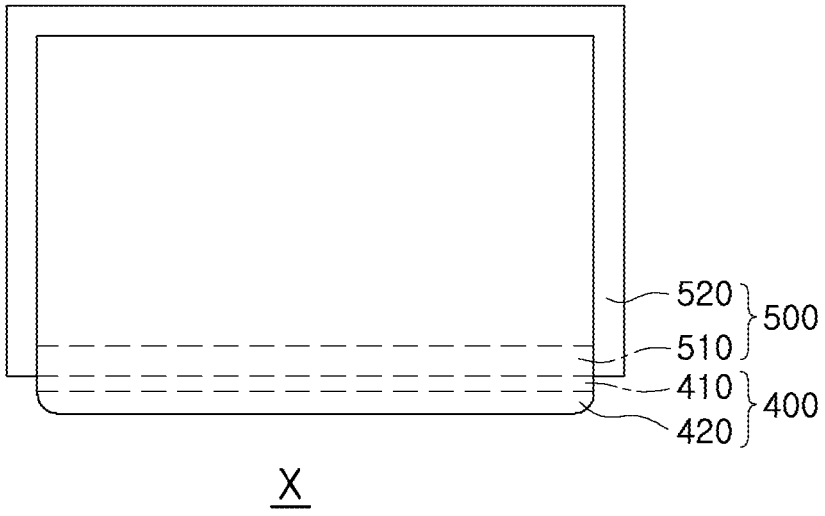
FIG. 3 is a side view along a direction X of FIG. 1.
Figure 4:
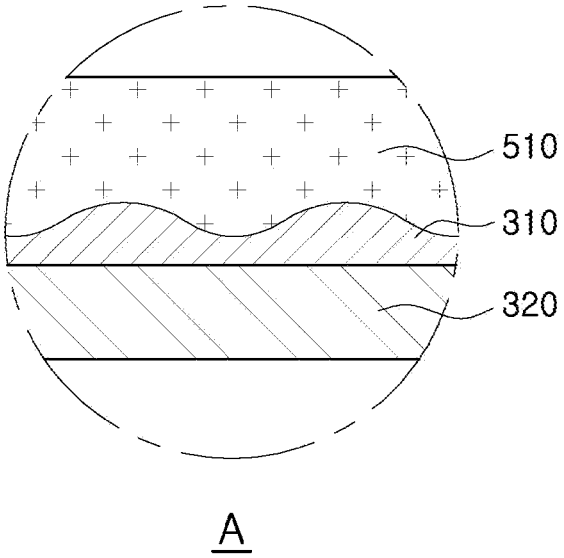
FIGS. 4 and 5 are enlarged views of a portion A of FIG. 2.
Figure 5:
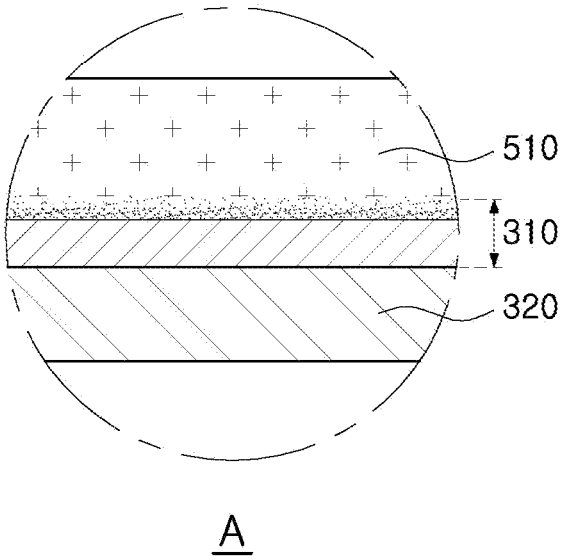

FIG. 1 is a perspective view schematically illustrating a coil component according to a first exemplary embodiment in the present disclosure. FIG. 2 is a view illustrating a cross section taken along a line I-I' of FIG. 1. FIG. 3 is a side view along a direction X of FIG. 1. FIGS. 4 and 5 are enlarged views of a portion A of FIG. 2.

Referring to FIGS. 1 through 5, a coil component 1000 according to an exemplary embodiment in the present disclosure may include a body 100, a coil part 200, first and second external electrodes 300 and 400, and an insulating layer 500.

The body 100 may form an outer shape of the coil component 1000 according to the present exemplary embodiment and may have the coil part 200 embedded therein.

The body 100 may be formed in a hexahedral shape as a whole.

Hereinafter, an exemplary embodiment in the present disclosure will be described on the assumption that the body 100 has illustratively the hexahedral shape. However, such a description does not exclude a coil component including a body formed in a shape other than the hexahedral shape from the scope of the exemplary embodiment in the present disclosure.

The body 100 may include a first surface and a second surface opposing each other in a length direction (L), a third surface and a fourth surface opposing each other in a width direction (W), and a fifth surface and a sixth surface opposing each other in a thickness direction (T). The first to fourth surfaces of the body 100 may correspond to wall surfaces of the body 100 connecting the fifth surface and the sixth surface of the body 100 to each other. The wall surfaces of the body 100 may include the first surface and the second surface, which are both end surfaces opposing each other, and the third surface and the fourth surface, which are both side surfaces opposing each other. An upper surface and a lower surface of the body 100 may correspond to the fifth surface and the sixth surface of the body, respectively.

The body 100 may be illustratively formed so that the coil component 1000 according to the present exemplary embodiment in which the external electrodes 300 and 400 and the insulating layer 500 to be described below are formed has a length of 2.0 mm, a width of 1.2 mm, and a thickness of 0.65 mm, but is not limited thereto. Meanwhile, the length, width, and thickness values of the above described coil component exclude tolerance, and the actual length, width, and thickness of the coil component due to the tolerance may be different from the above values.

The body 100 may contain a magnetic material and a resin. Specifically, the body may be formed by stacking one or more magnetic composite sheets in which the magnetic material is dispersed in the resin. However, the body 100 may also have a structure other than the structure in which the magnetic material is dispersed in the resin. For example, the body 100 may also be formed of the magnetic material such as a ferrite.

The magnetic material may be a ferrite or a metallic magnetic powder.

The ferrite may include at least one or more of a spinel type ferrite such as Mg—Zn based, Mn—Zn based, Mn—Mg based, Cu—Zn based, Mg—Mn—Sr based, Ni—Zn based, or the like, a hexagonal type ferrite such as Ba—Zn based, Ba—Mg based, Ba—Ni based, Ba—Co based, Ba—Ni—Co based, or the like, and garnet type ferrite such as Y-based or the like, and Li-based ferrite.

The metallic magnetic powder may include one or more selected from a group consisting of iron (Fe), silicon (Si), chromium (Cr), cobalt (Co), molybdenum (Mo), aluminum (Al), niobium (Nb), copper (Cu), and nickel (Ni). For example, the metallic magnetic powder may include at least one or more of pure iron powder, Fe—Si based alloy powder, Fe—Si—Al based alloy powder, Fe—Ni based alloy powder, Fe—Ni—Mo based alloy powder, Fe—Ni—Mo—Cu based alloy powder, Fe—Co based alloy powder, Fe—Ni—Co based alloy powder, Fe—Cr based alloy powder, Fe—Cr—Si based alloy powder, Fe—Si—Cu—Nb based alloy powder, Fe—Ni—Cr based alloy powder, Fe—Cr—Al based alloy powder, and the like.

The metallic magnetic powder may be amorphous or crystalline. For example, the metallic magnetic powder may be Fe—Si—B—Cr based amorphous alloy powder, but is not necessarily limited thereto.

Each of the ferrite and the metallic magnetic powder may have an average diameter within a range from about 0.1 μm to 30 μm, but is not limited thereto.

The body 100 may include two or more kinds of magnetic materials dispersed in the resin. Here, a meaning that the magnetic materials are different kinds means that the magnetic materials dispersed in the resin are distinguished from each other by any one of an average diameter, a composition, a crystallinity and a shape.

The resin may include, but is not limited to, epoxy, polyimide, liquid crystal polymer, etc., alone or in combination.

The body 100 may include a core 110 penetrating through the coil part 200 to be described below. The core 110 may be formed by filling a through-hole of the coil part 200 with the magnetic composite sheet, but is not limited thereto.

The coil part 200 may be embedded in the body 100 and first and second ends of the coil part 200 may be exposed to first and second end surfaces opposing each other of the plurality of surface walls of the body 100, respectively. That is, a first end of the coil part 200 may be exposed to the first surface of the body, which is one end surface of the body 100, and a second end of the coil part 200 may be exposed to the second surface of the body, which is the other end surface of the body 100. In a case in which the coil part 200 includes first and second coil patterns 211 and 212 to be described below, one end of the coil part 200 may be one end of the first coil pattern 211 and the other end of the coil part 200 may be one end of the second coil pattern 212.

The coil part 200 may manifest characteristics of the coil component. For example, in a case in which the coil component 1000 is utilized as a power inductor, the coil part 200 may serve to stabilize power of the electronic device by storing an electric field as a magnetic field and maintaining an output voltage.

The coil part 200 may include a first coil pattern 211, a second coil pattern 212, and a via.

The first coil pattern 211, and the second coil pattern 212, and an internal insulating layer IL to be described below may be sequentially stacked along the thickness direction T of the body 100. That is, referring to FIG. 2, the first coil pattern 211 may be disposed on a lower surface of the internal insulating layer IL and the second coil pattern 212 may be disposed on an upper surface of the internal insulating layer IL.

Each of the first coil pattern 211 and the second coil pattern 212 may be formed in a shape of a flat spiral. As an example, the first coil pattern 211 may form at least one turn around the thickness direction T of the body 100 on one surface of the internal insulating layer IL.

The via may penetrate through the internal insulating layer IL to electrically connect the first coil pattern 211 and the second coil pattern 212 to each other and may be in contact with the first coil pattern 211 and the second coil pattern 212, respectively. As a result, the coil part 200 applied to the present exemplary embodiment may be formed as a single coil generating a magnetic field in the thickness direction (T) of the body 100.

At least one of the first coil pattern 211, the second coil pattern 212, and the via may include one or more conductive layers.

As an example, in a case in which the second coil pattern 212 and the via are formed by a plating method, the second coil pattern 212 and the via may include a seed layer of an electroless plating layer and an electroplating layer, respectively. Here, the electroplating layer may have a single layer structure or a multilayer structure. The electroplating layer having the multilayer structure may also be formed in a conformal film structure in which the other electroplating layer covers any one electroplating layer, or may also be formed in a shape in which the other electroplating layer is formed only on one surface of any one electroplating layer. The seed layer of the second coil pattern 212 and the seed layer of the via may be integrally formed without forming a boundary therebetween, but are not limited thereto. The electroplating layer of the second coil pattern 212 and the electroplating layer of the via may be integrally formed without forming a boundary therebetween, but are not limited thereto.

As another example, in a case in which the first coil pattern 211 and the second coil pattern 211 are separately formed and are then stacked together on the internal insulating layer IL to form the coil portion 200, the via may include a high melting point metal layer and a low melting point metal layer having a melting point lower than the melting point of the high melting point metal layer. Here, the low melting point metal layer may be formed of a solder including a lead (Pb) and/or tin (Sn). The low melting point metal layer is at least partially melted due to the pressure and temperature at the time of stacking together the first coil pattern 211 and the second coil pattern 212, such that an inter metallic compound (IMC) layer may be formed between the low melting point metal layer and the second coil pattern 212.

As an example, the first coil pattern 211 and the second coil pattern 212 may protrude on a lower surface and an upper surface of the internal insulating layer IL, respectively, as illustrated in FIG. 2. As another example, the first coil pattern 211 is embedded in the lower surface of the internal insulating layer IL such that a lower surface of the first coil pattern 211 may be exposed to the lower surface of the internal insulating layer IL, and the second coil pattern 212 may protrude on the upper surface of the internal insulating layer IL. In this case, a concave portion may be formed in the lower surface of the first coil pattern 211. As a result, the lower surface of the internal insulating layer IL and the lower surface of the first coil pattern 211 may not be substantially positioned on the same plane. As another example, the first coil pattern 211 is embedded in the lower surface of the internal insulating layer IL such that the lower surface of the first coil pattern 211 may be exposed to the lower surface of the internal insulating layer IL, and the second coil pattern 212 is embedded in the upper surface of the internal insulating layer IL such that an upper surface of the second coil pattern 212 may be exposed to the upper surface of the internal insulating layer IL.

End portions of the first coil pattern 211 and the second coil pattern 212, respectively, may be exposed to the first surface and the second surface of the body 100. As a result, both ends of the coil part 200 may be exposed to the first surface and the second surface, which are both end surfaces of the body 100. The end portion of the first coil pattern 211 exposed to the first surface of the body 100 may be in contact with a first external electrode 300 to be described above, such that the first coil pattern 211 may be electrically connected to the first external electrode 300. The end portion of the second coil pattern 212 exposed to the second surface of the body 100 may be in contact with a second external electrode 400 to be described above, such that the second coil pattern 212 may be electrically connected to the second external electrode 400.

Each of the first coil pattern 211, the second coil pattern 212, and the via may be formed of a conductive material such as copper (Cu), aluminum (Al), silver (Ag), tin (Sn), gold (Au), nickel (Ni), lead (Pb), titanium (Ti), or alloys thereof, but is not limited thereto.

The internal insulating layer IL may be formed of an insulating material including at least one of a thermosetting resin such as an epoxy resin, a thermoplastic resin such as polyimide, and a photosensitive insulating resin, or may be formed of an insulating material having a reinforcement material such as a glass fiber or an inorganic filler impregnated in the insulating resin. As an example, the internal insulating layer IL may be formed of an insulating material such as prepreg, Ajinomoto Build-up Film (ABF), FR-4, Bismaleimide Triazine (BT) resin, photo imagable dielectric (PID), or the like.

As an inorganic filler, at least one selected from the group consisting of silica ($SiO_2$), alumina ($Al_2O_3$), silicon carbide (SiC), barium sulfate ($BaSO_4$), talc, clay, mica powder, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$) and calcium zirconate ($CaZrO_3$) may be used.

In a case in which the internal insulating layer IL is formed of the insulating material including the reinforcement material, the internal insulating layer IL may provide more excellent rigidity. In a case in which the internal insulating layer IL is formed of an insulating material that does not include the glass fiber, the internal insulating layer IL may be advantageous for thinning the total thickness of the coil part 200. In a case in which the internal insulating layer IL is formed of an insulating material including the photosensitive insulating resin, the number of processes may be reduced, which is advantageous in reducing the production cost, and fine hole machining may be possible.

The insulating film IF may be formed along the surfaces of the first coil pattern 211, the internal insulating layer IL, and the second coil pattern 212. The insulating film IF, which protects and insulates the respective coil patterns 211 and 212, may include a known insulating material such as parylene. The insulating material included in the insulating film IF may be any material and is not particularly limited. The insulating film IF may be formed by vapor deposition or the like, but is not limited thereto, and may also be formed by stacking an insulating film on both surfaces of the internal insulating layer IL on which the first and second coil patterns 211 and 212 are formed.

Meanwhile, although not illustrated, at least one of the first coil pattern 211 and the second coil pattern 212 may be formed in plural. As an example, the coil part 200 may have a structure in which a plurality of first coil patterns 211 are formed and the other of the first coil patterns is stacked on one of the first coil patterns. In this case, an additional insulating layer may be disposed between a plurality of first coil patterns 211 and the plurality of first coil patterns 211 may be connected to each other by a connection via penetrating through the additional insulating layer, but are not limited thereto.

The insulating layer 500 may cover the surfaces of the body except for both end surfaces of the body 100. Specifically, referring to FIGS. 2 and 3, the insulating layer 500 may include a first insulating layer 510 covering the sixth surface of the body 100, which is the lower surface of the body 100, and a second insulating layer 520 covering the fifth surface of the body 100, which is the upper surface of the body 100, and the third and fourth surfaces of the body 100, which are both side surfaces of the body 100.

Since the first insulating layer 510 covers the entire lower surface of the body 100 and the first and second external electrodes 300 and 400 to be described below include portions formed on the first insulating layer 510, the first insulating layer 510 may increase an insulation distance between the first and second external electrodes 300 and 400, and improve a breakdown voltage (BDV) of the coil component 1000 according to the present exemplary embodiment.

Further, since the first insulating layer 510 is interposed between the first and second external electrodes 300 and 400 and the lower surface of the body 100, the first insulating layer 510 may reduce surface roughness of exposed surfaces of the first and second external electrodes 300 and 400. That is, since the body 100 shrinks due to heating in a process of forming the body 100, the surfaces of the body 100 may have a relatively high surface roughness. When relatively thin external electrodes are directly formed on the surfaces of the body 100, the surface roughness of the exposed surfaces of the external electrodes may be increased. According to the present exemplary embodiment, since the first insulating layer 510 is formed between the first and second external electrodes 300 and 400 and the lower surface of the body 100, the first insulating layer 510 may serve to alleviate the relatively high surface roughness of the lower surface of the body 100.

The second insulating layer 520 may be formed on regions of the surfaces of the body 100 on which the first and second external electrodes 300 and 400 and the first insulating layer 510 are not formed. Therefore, the second insulating layer 520 may protect the coil component 1000 according to the present exemplary embodiment from the outside and increase the insulation distance to further improve the breakdown voltage (BDV) of the coil component 1000 according to the present exemplary embodiment.

The insulating layer 500 may be formed of a thermoplastic resin such as a polystyrene based, a vinyl acetate based, a polyester based, a polyethylene based, a polypropylene based, a polyamide based, a rubber based, and an acrylic based, a thermosetting resin such as a phenol based, an epoxy based, a urethane based, a melamine based, and an alkyd based, a photosensitive resin, parylene, SiOx, or SiNx.

The insulating layer 500 may be formed by applying a liquid insulating resin onto the surfaces of the body 100, stacking an insulating film on the surfaces of the body 100, or forming an insulating resin on the surfaces of the body 100 by vapor deposition. As the insulating film, a dry film DF including a photosensitive insulating resin, an Ajinomoto Build-up Film (ABF) that does not include the photosensitive insulating resin, or a polyimide film may be used. In a case in which the insulating layer 500 is formed by stacking the insulating film on the surfaces of the body 100 and heating and pressuring the insulating film, the surfaces of the external electrodes 300 and 400 may be more flatly formed.

The insulating layer 500 may be formed in a range of a thickness within a range from 10 nm to 100 μm on the third to sixth surfaces of the body, respectively. Ina case in which the thickness of the insulating layer 500 is less than 10 nm, a Q factor, the breakdown voltage (BDV), and a self-resonant frequency (SRF) may be reduced and the characteristics of the coil component may be reduced. In a case in which the thickness of the insulating layer 500 exceeds 100 μm, the total length, width, and thickness of the coil component may increase, which is disadvantageous for thinning.

The first and second external electrodes 300 and 400 may be each disposed on both end surfaces of the body and extend onto the first insulating layer 510, and may include bonded conductive layers 310 and 410 formed on the first insulating layer 510, and external conductive layers 320 and 420 formed on the bonded conductive layers 310 and 410, respectively. That is, the first external electrode 300 may be disposed on the first surface of the body 100, which is one end surface of the body 100, be connected to the first coil pattern 211, and extend onto the first insulating layer 510. The second external electrode 400 may be disposed on the second surface of the body 100, which is the other end surface of the body 100, be connected to the second coil pattern 212, and extend onto the first insulating layer 510. The first external electrode 300 may include a first bonded conductive layer 310 formed on the first insulating layer 510 and a first external conductive layer 320 formed on the first bonded conductive layer 310. The second external electrode 400 may include a second bonded conductive layer 410 formed on the first insulating layer 510 and a second external conductive layer 420 formed on the second bonded conductive layer 410.

According to the present exemplary embodiment, the bonded conductive layers 310 and 410 may be formed only on the first insulating layer 510, and the external conductive layers 320 and 420 may be formed on the bonded conductive layers 310 and 410 and extend to both end surfaces of the body 100.

The bonded conductive layers 310 and 410 may improve coupling force of the external conductive layers 320 and 420 when the external conductive layers 320 and 420 are formed on the first insulating layer 510. In addition, in a case in which the external conductive layers 320 and 420 are formed by electroplating, the bonded conductive layers 310 and 410 may serve as a seed layer so that the external conductive layers 320 and 420 are formed on the first insulating layer 510.

The bonded conductive layers 310 and 410 may include at least one of titanium (Ti), chromium (Cr), and copper (Cu). The bonded conductive layers 310 and 410 may be formed by vapor deposition such as sputtering, but is not limited thereto.

At least a portion of the bonded conductive layers 310 and 410 may permeate into the first insulating layer 510. Referring to FIGS. 4 and 5, in a case in which the bonded conductive layers 310 and 410 are formed on the first insulating layer 510 by specific vapor deposition, a vaporized material for forming the bonded conductive layers may be accelerated and permeate into the first insulating layer 510. In a case in which the material for forming the bonded conductive layers permeating into the first insulating layer 510 is relatively concentrated in a certain region of the first insulating layer 510, the bonded conductive layers 310 and 410 may protrude to the first insulating layer 510 at an interface with the first insulating layer 510 as illustrated in FIG. 4. Alternatively, in a case in which the material for forming the bonded conductive layers relatively uniformly permeate into entire surfaces of the first insulating layer 510, the bonded conductive layers 310 and 410 may include a mixed layer in which the insulating resin of the first insulating layer 510 and the material for forming the bonded conductive layers are mixed as illustrated in FIG. 5. A density of the material for forming the bonded conductive layers in the mixed layer may be lowered toward the surfaces of the body.

The external conductive layers 320 and 420 may be formed of a conductive material such as copper (Cu), aluminum (Al), silver (Ag), tin (Sn), gold (Au), nickel (Ni), lead (Pb), titanium (Ti), or alloys thereof, but are not limited thereto.

The external conductive layers 320 and 420 may be formed by vapor deposition such as sputtering or electroplating. In forming the external conductive layers 320 and 420 by electroplating, when the body 100 includes a metallic magnetic powder, portions of the external conductive layers 320 and 420 disposed on both end surfaces of the body 100 may be formed on both end surfaces of the body 100 without a separate seed layer. At this time, the second insulating layer 520 formed on both side surfaces of the body 100 and the other surface of the body may serve as a plating resist.

Portions of the external conductive layers 320 and 420 disposed on the first insulating layer 510 and portions of the external conductive layers 320 and 420 disposed on both end surfaces of the body 100 are formed by separate processes from each other, such that a boundary therebetween may also be formed. However, in order to reduce the number of processes, the above-mentioned portions are formed by a single process, such that the boundary therebetween may not be formed.

In a case in which the bonded conductive layers 310 and 410 and the external conductive layers 320 and 420 are formed by vapor deposition, surfaces opposing each other of the bonded conductive layers 310 and 410 may be exposed without being covered by the external conductive layers 320 and 420. This may be because a mask is formed on the first insulating layer, the bonded conductive layers and the external conductive layers are formed by vapor deposition, and the mask is then removed.

In a case in which the external conductive layers 320 and 420 are formed by electroplating, surfaces opposing each other of the bonded conductive layers 310 and 410 may be covered by the external conductive layers 320 and 420. This is because the bonded conductive layers 310 and 410 serve as the seed layer when the external conductive layers 320 and 420 are formed by electroplating and the external conductive layers 320 and 420 are formed on all surfaces of the bonded conductive layers 310 and 410 except for the surfaces of the bonded conductive layers 310 and 410 which are in contact with the first insulating layer 510.

The first and second external electrodes 300 and 400 may be formed to have a thickness within a range from 0.5 μm to 100 μm. In a case in which the thickness of the external electrodes 300 and 400 is less than 0.5 μm, when the substrate is mounted, delamination may occur. In a case in which the thickness of the external electrodes 300 and 400 exceeds 100 μm, it may be disadvantageous for thinning the coil component.

By doing so, the coil component 1000 according to the present exemplary embodiment may increase the breakdown voltage (BDV) due to an increase in the insulation distance.

In addition, the coil component 1000 according to the present exemplary embodiment may more easily and precisely implement a printed circuit board or an electronic package in which the electronic component is embedded. That is, in the case of the printed circuit board or the electronic package in which the electronic component is embedded, after the electronic component is surrounded by an insulating member to fix the electronic component, a hole machining may be optically performed on the insulating member for connection with the electronic component. At this time, since the portions of the external electrodes 300 and 400 formed on the first insulating layer 510 applied to the coil component 1000 according to the present exemplary embodiment have the relatively low surface roughness, scattering of light may be reduced during the optical hole machining, and holes may be machined more precisely.

Meanwhile, although not illustrated, the external conductive layers 320 and 420 may be formed in a structure of a plurality of layers. As an example, the external conductive layers 320 and 420 may be formed in a three-layer structure including a first layer including copper (Cu), a second layer including nickel (Ni), and a third layer including tin (Sn), but is not limited thereto. In addition, in the above example, the second layer and the third layer are formed only on the first insulating layer 510 and may not be disposed on both end surfaces of the body 100 or may be disposed only on a portion of both end surfaces of the body, but are not limited thereto. In addition, in the above example, the first to third layers may be all formed by electroplating, but are not limited thereto.

Second Exemplary Embodiment

Figure 6:
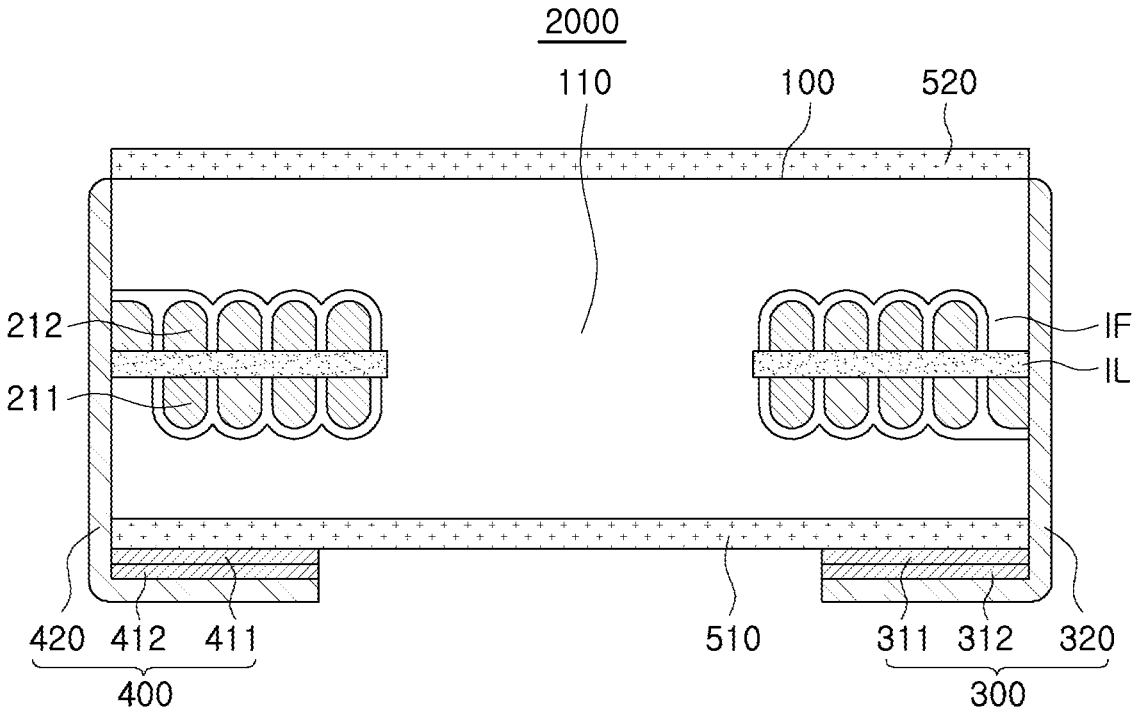
FIG. 6 is a view illustrating schematically a coil component according to a second exemplary embodiment in the present disclosure and corresponding the cross section taken along the line I-I' of FIG. 1.

FIG. 6 is a view illustrating schematically a coil component according to a second exemplary embodiment in the present disclosure and corresponding the cross section taken along the line I-I' of FIG. 1.

Referring to FIG. 6, a coil component according to a second exemplary embodiment in the present disclosure is different from the coil component 1000 according to the first exemplary embodiment in the present disclosure in a structure of bonded conductive layers 311, 312, 411, and 412.

Specifically, each of the bonded conductive layers 311, 312, 411, and 412 applied to the present exemplary embodiment may be formed in a structure of a plurality of layers. As an example, as illustrated in FIG. 6, each of the first bonded conductive layers 311 and 312 and the second bonded conductive layers 411 and 412 may be formed in a double-layer structure.

Referring to FIG. 6, the bonded conductive layers 311 and 411 which are directly formed on the first insulating layer 510 and disposed on an upper portion may include a metal having superior bonding force for ensuring bonding force with the first insulating layer 510, for example, at least one of titanium (Ti) and chromium (Cr), but are not limited thereto. The bonded conductive layers 312 and 412 disposed on a lower portion of the upper bonded conductive layers 311 and 411 may include copper (Cu), but are not limited thereto.

Third Exemplary Embodiment

Figure 7:
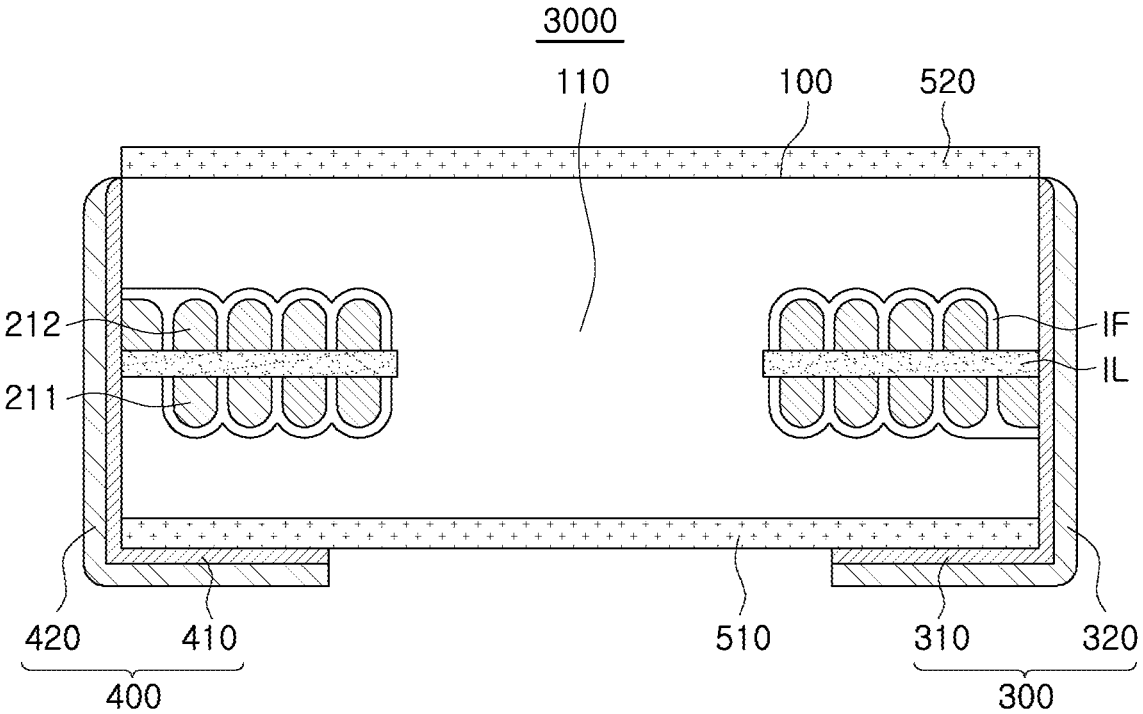
FIG. 7 is a view illustrating schematically a coil component according to a third exemplary embodiment in the present disclosure and corresponding the cross section taken along the line I-I' of FIG. 1.

FIG. 7 is a view illustrating schematically a coil component according to a third exemplary embodiment in the present disclosure and corresponding to the cross section taken along the line I-I' of FIG. 1.

Referring to FIG. 7, a coil component according to a third exemplary embodiment in the present disclosure is different from the coil component 1000 according to the first exemplary embodiment in the present disclosure in a structure of the bonded conductive layers 310 and 410.

Specifically, each of the bonded conductive layers 310 and 410 applied to the present exemplary embodiment may be formed on the first insulating layer 510 and extend to both end surfaces of the body 100. Thereby, the external conductive layers 320 and 420 applied to the present exemplary embodiment may not be directly formed on both end surfaces of the body 100.

Meanwhile, in a case in which the bonded conductive layers 310 and 410 are formed on both end surfaces of the body 100 by the above-mentioned specific vapor deposition, at least a portion of the bonded conductive layers 310 and 410 may permeate into both end surfaces of the body 100.

According to the present exemplary embodiment, since the bonded conductive layers 310 and 410 are formed not only on the first insulating layer 510 but also on both end surfaces of the body 100, coupling force of the external conductive layers 320 and 420, particularly, the external electrodes 300 and 400 to the body 100 may be further improved.

As set forth above, according to an exemplary embodiment in the present disclosure, the coil component may be easily thinned.

Further, according to the present disclosure, the breakdown voltage (BDV) of the coil component may be improved.

While exemplary embodiments have been shown and described above, it will be apparent to those skilled in the art that modifications and variations could be made without departing from the scope of the present invention as defined by the appended claims.

What is claimed is:

1. A coil component comprising:

a body having first and second surfaces opposing each other, and a plurality of wall surfaces connecting the first and second surfaces to each other;

a coil part embedded in the body and having first and second ends respectively exposed to first and second end surfaces of the plurality of wall surfaces of the body, the first and second end surfaces opposing each other;

an insulating layer covering one surface of the body; and first and second external electrodes disposed on the first and second end surfaces of the body, respectively, extending onto the insulating layer, and including a conductive layer disposed on the insulating layer, and an external conductive layer disposed on the conductive layer, respectively, wherein the conductive layer includes a first surface adjacent the insulating layer and a second surface adjacent the external conductive layer, and wherein a surface roughness of the first surface is greater than a surface roughness of the second surface.

2. The coil component of claim 1, wherein the conductive layer includes at least one of titanium (Ti), chromium (Cr), and copper (Cu).

3. The coil component of claim 1, wherein the external conductive layer includes copper (Cu).

4. The coil component of claim 1, wherein at least a portion of the conductive layer permeates into the insulating layer.

5. The coil component of claim 1, wherein the external conductive layer is in contact with one end surface of the body and extends onto the conductive layer.

6. The coil component of claim 5, wherein the external conductive layer covers the conductive layer.

7. The coil component of claim 5, wherein the external conductive layer is integrally formed.

8. The coil component of claim 1, wherein the conductive layer extends to one end surface of the body from the insulating layer.

9. The coil component of claim 8, wherein the external conductive layer covers the conductive layer.

10. The coil component of claim 8, wherein the external conductive layer is integrally formed.

11. The coil component of claim 1, wherein the insulating layer is disposed on the second surface of the body, and both side surfaces connecting both end surfaces of the body to each other of the plurality of wall surfaces of the body.

12. The coil component of claim 1, wherein the conductive layer comprises a plurality of layers.

13. A coil component, comprising:

a body including a coil part;

an external electrode disposed on the body; and an insulating layer covering a mounting surface of the body, wherein the external electrode includes a conductive layer disposed on the insulating layer, and an external conductive layer disposed on the conductive layer, and extending to an end surface of the body, wherein the conductive layer includes a first surface adjacent the insulating layer and a second surface adjacent the external conductive layer, and wherein a surface roughness of the first surface is greater than a surface roughness of the second surface.

14. The coil component of claim 13, wherein the conductive layer includes at least one of titanium (Ti), chromium (Cr), and copper (Cu).

15. The coil component of claim 13, wherein the external conductive layer includes copper (Cu).

16. The coil component of claim 13, wherein at least a portion of the conductive layer permeates into the insulating layer.

* * * * *